US011612802B2

(12) United States Patent
Schaefer

(10) Patent No.: US 11,612,802 B2
(45) Date of Patent: Mar. 28, 2023

(54) RANGE-OF-MOTION EXERCISE DEVICE HAVING AN AUDIBLE FEEDBACK MECHANISM

(71) Applicant: Michael Schaefer, McKinney, TX (US)

(72) Inventor: Michael Schaefer, McKinney, TX (US)

( * ) Notice: Subject to any disclaimer, the term of this patent is extended or adjusted under 35 U.S.C. 154(b) by 134 days.

(21) Appl. No.: 17/127,553

(22) Filed: Dec. 18, 2020

(65) Prior Publication Data

US 2022/0193523 A1 Jun. 23, 2022

(51) Int. Cl.

| | |
|---|---|
| ***A63B 71/06*** | (2006.01) |
| ***A63B 21/06*** | (2006.01) |
| ***A63B 23/14*** | (2006.01) |
| ***A63B 21/00*** | (2006.01) |
| ***A63B 23/035*** | (2006.01) |

(52) U.S. Cl.

CPC ..... *A63B 71/0622* (2013.01); *A63B 21/0608* (2013.01); *A63B 21/4035* (2015.10); *A63B 23/03508* (2013.01); *A63B 23/14* (2013.01); *A63B 2071/0633* (2013.01)

(58) Field of Classification Search

CPC ... A63B 15/00; A63B 15/005; A63B 21/0004; A63B 21/00058; A63B 21/00065; A63B 21/0608; A63B 21/4033; A63B 21/4035; A63B 23/035; A63B 23/03508; A63B 23/14; A63B 71/0054; A63B 71/0619; A63B 71/0622; A63B 2071/0072; A63B 2071/0625; A63B 2071/0633; A63B 2225/09

See application file for complete search history.

(56) References Cited

U.S. PATENT DOCUMENTS

| | | | | | |
|---|---|---|---|---|---|
| 4,203,591 | A * | 5/1980 | Gibson | A63B 23/14 | 482/46 |
| 4,557,479 | A * | 12/1985 | Guibert | A63B 21/4047 | 482/44 |
| 4,585,363 | A * | 4/1986 | McGuire | A63B 21/4047 | 482/44 |
| 4,702,474 | A * | 10/1987 | Guibert | A63B 21/4035 | 482/44 |
| 4,921,246 | A * | 5/1990 | Hornbostel | A63B 21/0724 | 482/106 |
| 5,209,481 | A * | 5/1993 | DeBack | A63B 21/4047 | 473/220 |
| 5,281,192 | A * | 1/1994 | Nelson | A63B 21/4035 | 482/109 |
| 5,312,308 | A * | 5/1994 | Hamilton | A63B 21/072 | 482/44 |
| 5,676,622 | A * | 10/1997 | McFarlane | A63B 23/14 | 482/109 |

(Continued)

*Primary Examiner* — Gary D Urbiel Goldner

(74) *Attorney, Agent, or Firm* — Andrew S. Rapacke

(57) ABSTRACT

An apparatus, kit, and method for rehabilitating and/or strengthening the soft tissues of a user's lower arm is disclosed. The apparatus has a first arm with a proximal end and a distal end; a second arm with a proximal end, a distal end, one or more discrete sections therebetween for engaging one or more weights, and a means for providing an audible feedback to the user upon completion of an exercise repetition or a half-repetition; and a hinge in contact with the proximal ends of the first and second arms. The hinge is configured to adjust the distance between the distal ends of the first and second arms, or the angle separating the first and second arms.

20 Claims, 13 Drawing Sheets

(56) References Cited

U.S. PATENT DOCUMENTS 7,104,934 B1 * 9/2006 Smith ..... A63B 23/16 482/44
D573,670 S * 7/2008 Mullins ..... D21/679
7,618,328 B2 * 11/2009 Davenport ..... A63B 69/3623 473/219
7,837,598 B1 * 11/2010 Boozel, Jr. ..... A63B 23/03525 482/38
8,012,070 B2 * 9/2011 James ..... A63B 21/00069 482/904
9,480,876 B1 * 11/2016 Blacklock ..... A63B 23/16
9,700,749 B2 * 7/2017 Carpinelli ..... A63B 21/00072
9,782,655 B1 * 10/2017 Novosel, Sr. ..... A63B 71/0622
10,213,676 B2 * 2/2019 Nowicki ..... A63B 71/0622
10,265,568 B2 * 4/2019 Silagy ..... A63B 23/14
10,744,388 B2 * 8/2020 Martikainen ..... A63B 69/3623
10,792,534 B2 * 10/2020 Klecka ..... A63B 21/0724
10,898,749 B2 * 1/2021 Ju ..... A63B 23/16
2002/0077227 A1 * 6/2002 Bastyr ..... A63B 21/00192 482/136
2003/0216229 A1 * 11/2003 Bastyr ..... A63B 21/00185 482/118
2007/0123398 A1 * 5/2007 Ljevaja ..... A63B 15/00 482/107
2007/0135273 A1 * 6/2007 Ljevaja ..... A63B 21/075 482/109
2008/0139332 A1 * 6/2008 Nelson ..... A63B 69/3621 473/226
2008/0248891 A1 * 10/2008 Nelson ..... A63B 69/3623 473/229
2009/0017931 A1 * 1/2009 Kurisu ..... A63B 69/3623 473/238
2012/0034989 A1 * 2/2012 Novosel, Sr. ..... A63B 15/00 473/409
2012/0088641 A1 * 4/2012 Shah ..... A63B 23/12 482/110
2019/0030414 A1 * 1/2019 Frost ..... A63B 69/3623

* cited by examiner

RANGE-OF-MOTION EXERCISE DEVICE HAVING AN AUDIBLE FEEDBACK MECHANISM

BACKGROUND

The present disclosure relates to an exercise device and methods of using the same, and more particularly to a rehabilitation and strengthening device and a method of strengthening forearm muscles to treat epicondylitis.

Epicondylitis can refer to inflammation of an epicondyle—a rounded projection at the end of a bone, located on or above a condyle (a rounded prominence at the end of a bone) and usually serving as a place of attachment for ligaments and tendons. The human skeleton includes several epicondyles, including the lateral epicondyle of the humerus bone, where tendons and extensor muscles (e.g., supinator) are located. Lateral epicondylitis, commonly referred to as tennis elbow, is caused by repetitive overuse of the forearm, causing inflammation of the tendons and forearm muscles on the outside of the elbow. Medial epicondylitis, sometimes referred to as golfer's elbow, causes inflammation to the tendons and muscles on the inside of the elbow—those involved when flexing the digits of a hand, or flexing and pronating the wrist. The inflammation and related stresses on the tendons can be very painful. Rest, ice therapy, massage therapy, anti-inflammatory drugs, and/or compression sleeves can be recommended as initial treatments for the pain related to epicondylitis. Physical therapy can then be recommended because specific exercises can stimulate the circulation of blood around the affected area (to pump away waste products of inflammation) and gradually strengthen the muscles involved.

There are six primary exercises for treating epicondylitis: flexion, extension, supination, pronation, radial deviation, and ulnar deviation. Each exercise involves the purposeful movement of a hand-held resistance device designed to activate specific groups of forearm muscles. Known exercise devices may perform one or more, but not all of the six exercises. For example, a dumbbell may be used for flexion or extension exercises, and a weighted stick may be used for pronation or supination, but the dumbbell and weighted sticks are not necessarily suitable for the other exercises. For at least these reasons, there is a need for a versatile and multi-functional device to treat epicondylitis.

SUMMARY

The foregoing general summary is intended to provide an overview or framework for understanding the nature and character of the embodiments disclosed herein. This summary is not intended to identify essential inventive concepts of the claimed subject matter or limit the scope of the claimed subject matter. Additional features and advantages of the embodiments disclosed herein will be set forth in the detailed description that follows, and in part will be clear to those skilled in the art from that description or recognized by practicing the embodiments described herein, including the detailed description that follows, the claims, and the appended drawings.

In various embodiments, an apparatus comprising a first arm comprising a proximal end and a distal end; a second arm comprising a proximal end, a distal end, and one or more discrete sections therebetween for engaging one or more weights; and a hinge in contact with the proximal ends of the first and second arms, wherein the hinge is configured to adjust the distance between the distal ends of the first and second arms, is provided.

In some embodiments, the one or more weights can slide between the two stops, and when the weight contacts one or both of the two stops, an auditory feedback is provided to a user.

In various embodiments, a rehabilitation and strengthening kit is provided. In such embodiments, the kit can comprise: an apparatus comprising a first arm comprising a proximal end and a distal end a second arm comprising a proximal end, a distal end, and one or more discrete sections therebetween for engaging one or more weights; and a hinge in contact with the proximal ends of the first and second arms, wherein the hinge is configured to adjust the distance between the distal ends of the first and second arms; a plurality of weights comprising a through-hole configured to slidably receive the second arm; and instructions for flexion, extension, supination, pronation, radial deviation, and ulnar deviation exercises that treat epicondylitis.

In various embodiments, a method of treating a person having epicondylitis is provided. In such embodiments, the method comprises providing the rehabilitation and strengthening kit; optionally sliding one or more weights from the plurality of weights onto the second arm; and articulating the apparatus according to the instructions for each of the flexion, extension, supination, pronation, radial deviation, and ulnar deviation exercises to rehabilitate and strengthen muscles to treat epicondylitis.

BRIEF DESCRIPTION OF THE DRAWINGS

A complete understanding of the present embodiments and the advantages and features thereof will be more readily understood by reference to the following detailed description, appended claims, and accompanying drawings, wherein:

Figure 1:
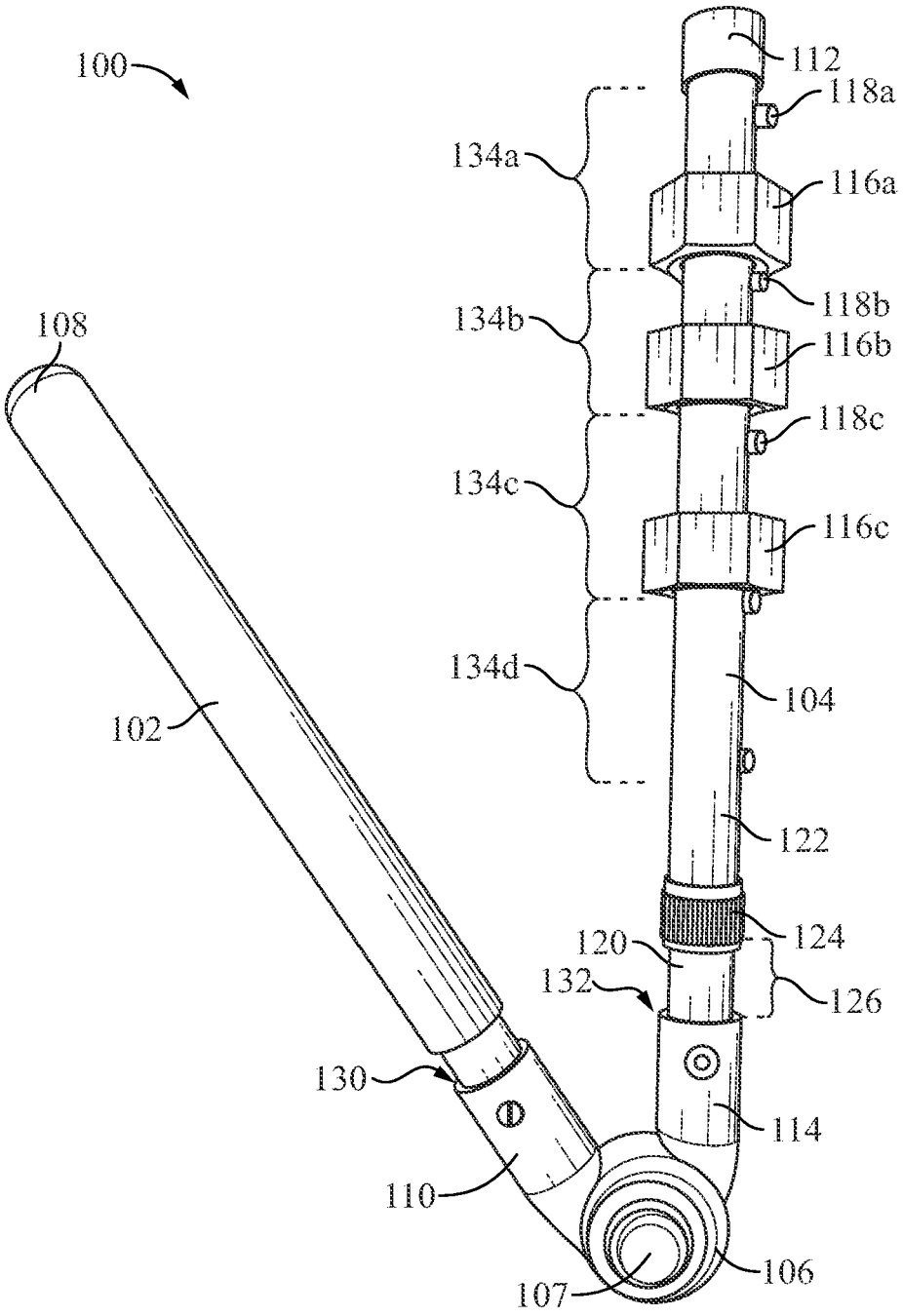
FIG. 1 illustrates a front view of a rehabilitation and strengthening apparatus with the second arm in a first position, according to some embodiments described herein.

The drawings are not necessarily to scale, and certain features and certain views of the drawings may be shown exaggerated in scale or in schematic in the interest of clarity and conciseness.

DETAILED DESCRIPTION

Reference will now be made in detail to the exemplary embodiment(s), examples of which is/are illustrated in the accompanying drawings. Whenever possible, the same reference numerals will be used throughout the drawings to refer to the same or like parts.

Before describing the exemplary embodiments, it is noted the embodiments reside primarily in combinations of components and procedures related to the apparatus. Accordingly, the apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

The specific details of the various embodiments described herein are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

In various embodiments, an apparatus and method for rehabilitating and strengthening the forearm muscles and surrounding soft tissues of a subject (e.g., person, patient), and/or for treating epicondylitis is provided.

FIGS. 1-13B illustrate some of the features included with certain embodiments described herein. In some embodiments, an apparatus 100 comprising a first arm 102, a second arm 104, and a hinge 106 is provided. The apparatus 100 is universally sized; i.e., configured for use by a person having hands of various sizes.

In some embodiments, as shown in FIGS. 1-7, the first arm 102 comprises a proximal end 110 and a distal end 108. In some embodiments, the first arm 102 comprises a handle, a grip, and/or a material suitable for the user to grip the apparatus 100 along its longitudinal axis ("grip"). In some embodiments, e.g., the first arm 102 slidably inserted into a polymeric material having a shape corresponding to and complementary to the shape of the first arm 102. For example, in such embodiments, the structure of the polymeric material comprises an opening on one end (a hollow core) configured to receive the first arm 102. For example, if the shape of the first arm 102 is cylindrical, then the shape of the grip will be tubular and have an opening configured to receive the cylindrically shaped first arm 102. As shown in FIGS. 1-12B, in some embodiments the first arm 102 can have an elongate cylindrical structure. In some embodiments, the length of the first arm 102 is adjustable. In some embodiments, the first arm 102 comprises two or more components.

In some embodiments, the second arm 104 comprises a proximal end 114, a distal end 112, and one or more discrete sections 134 for engaging one or more weights 116. In such embodiments, the one or more discrete sections 134 are positioned between the proximal end 114 and distal end 112 of the second arm 104. In some embodiments, the one or more discrete sections 134 are positioned along the longitudinal axis of the second arm 104. As shown in FIGS. 1-13B, the first and second arms (102, 104) can have an elongate structure, and the length of the first and/or second arms (102, 104) can be adjusted such that the arms extend the same or different distances from the hinge 106 when in use.

In some embodiments, the second arm 104 is sized and shaped to be slidable through an opening (i.e., through-hole) in the one or more weights 116. In such embodiments, the one or more weights 116 can be slid over the second arm 104 to a desired position (e.g., between two consecutive pins 118). The size and shape of the opening in the weight 116 and the size and shape of the second arm 104 should each be configured to allow the weight to slide freely in either direction. During use, as the apparatus 100 is tilted so the second arm 104 is not level, the weight 116 should be capable of sliding between two stops. For example, if the second arm 104 comprises two pins 118 located a spaced distance apart, then the weight 116 slides toward and contacts one of the two pins 118, and an auditory feedback is provided notifying the user that the full range of motion for the particular exercise has been met. In some embodiments, the apparatus 100 is configured so the second arm 104 will cross a horizontal plane when the range of motion is reached. The second arm 104 can include any suitable number of weights. For example, in some embodiments, the second arm 104 comprises at least three weights, each of which is slidable over the second arm and capable of providing an auditory feedback, either collectively or independently from the other weights.

In some embodiments, the length of the second arm 104 is adjustable. In some embodiments, the second arm 104 comprises two or more components. In some embodiments, the second arm 104 comprises two or more telescoping components. For example, as shown in FIGS. 1, 2, 5, and 7, the second arm 104 comprises a first component 122 that is configured to slidably receive a second component 120. In such embodiments, the length of the second arm 104 is adjusted by how far the second component 120 has been slid into the first component 122. In such embodiments, the first and second components 120, 122 can be securably coupled to one another by any suitable means.

Figure 2:
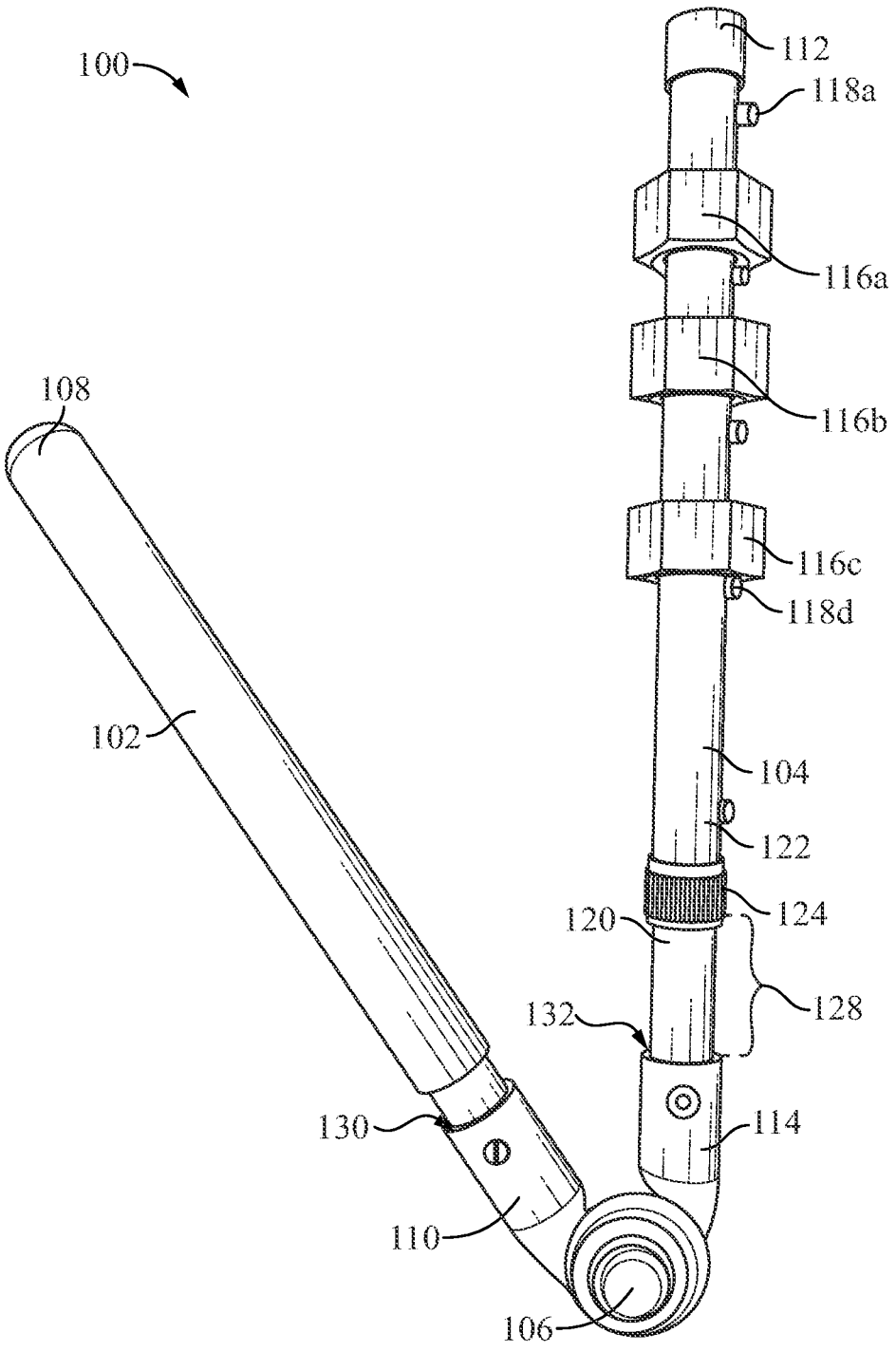
FIG. 2 illustrates a front view of the rehabilitation and strengthening apparatus of FIG. 1 with the second arm in a second (extended) position.
Figure 3:
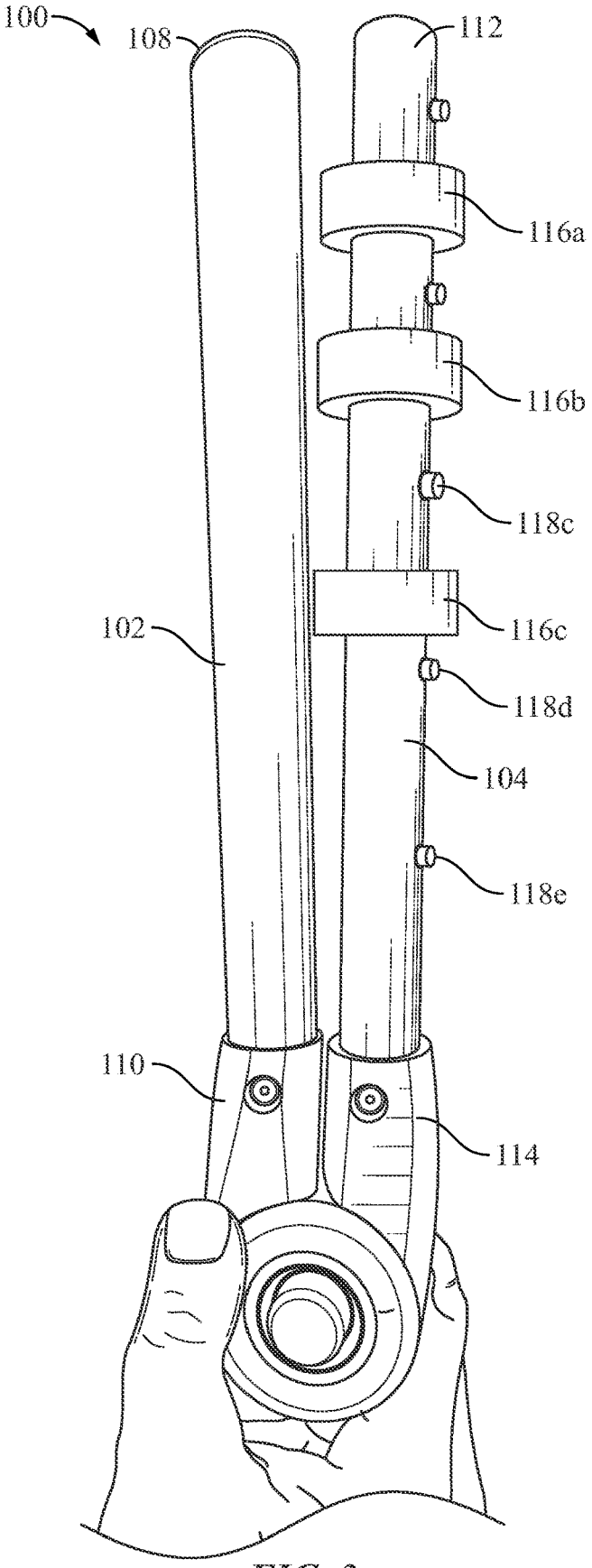
FIG. 3 illustrates a front view of a rehabilitation and strengthening apparatus, according to some embodiments described herein.
Figure 5:
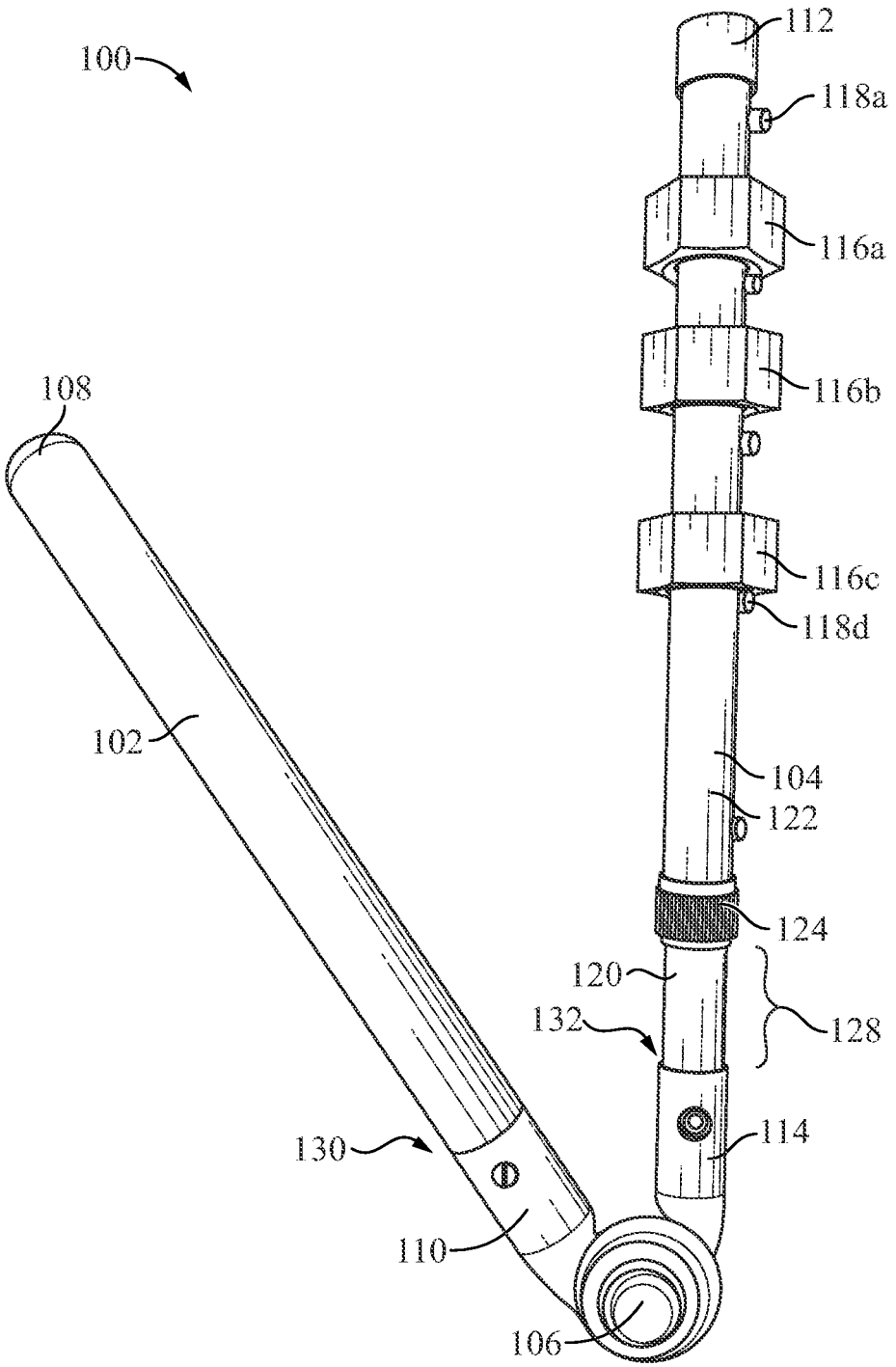
FIG. 5 illustrates a front view of a rehabilitation and strengthening apparatus with the second arm having two telescoping arm components (120, 122), according to some embodiments described herein.
Figure 6:
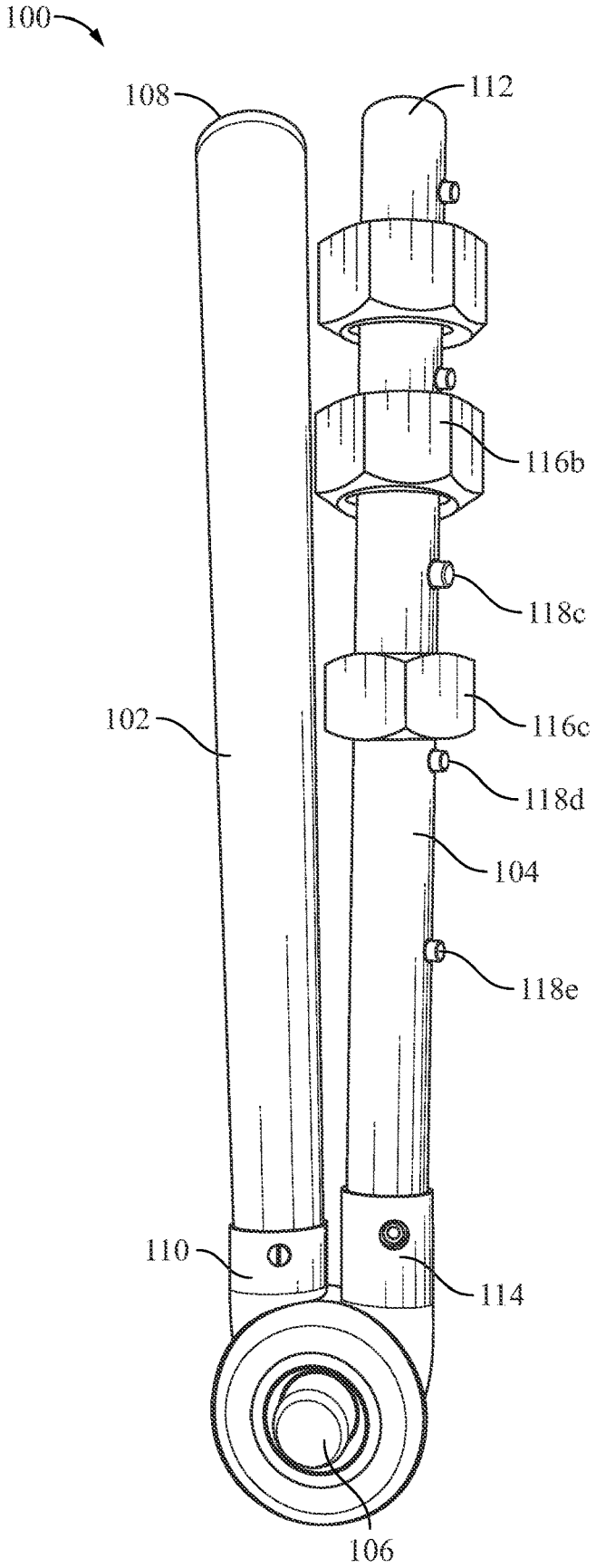
FIG. 6 illustrates a front view of a rehabilitation and strengthening apparatus with the second arm having a single, non-telescoping arm component (104), according to some embodiments described herein.

As shown in FIGS. 1, 2, and 5, for example, in some embodiments the second arm 104 includes a locking collar 124 that can be rotated about the second arm 104. As the collar 124 is rotated in one direction (e.g., clockwise), the collar 124 tightens and the second arm components 120, 122 are eventually locked in place. As the collar 124 is rotated in the opposite direction (e.g., counterclockwise), the collar 124 loosens and the second arm components 120, 122 are eventually free for repositioning along the longitudinal axis. In FIG. 1, for example, the collar 124 is tightened around the components 120 and 124, and the resulting length adjustment is the distance 126. In FIG. 2, the second arm 104 has been lengthened. When the collar 124 is loosened, the first component 122 can be slid out and away from the second component 120 and the resulting length adjustment is the distance 128 (which is longer than 126).

In some embodiments, as shown in FIGS. 1-7, the apparatus 100 comprises one or more pins (118*a*, 118*b*, 118*c*, . . . 118*n*) located along a longitudinal axis of the second arm 104. For each pin 118, the second arm 104 comprises a corresponding one or more through-holes 117 (117*a*, 117*b*, 117*c*, . . . 117*n*), each sized and shaped to receive a pin 118. In some embodiments, for example, each pin 118 is a push-pin (also referred to as a snap-button or push button locking pin) that is configured (e.g., as a spring loaded insert) to be pushed below the surface of the second arm 104 to allow a weight 116 to slide further along the second arm. In such embodiments, when force is applied to the pin 118 by a user, the pin is pushed down and the associated spring is compressed. When the force is removed from the pin, the spring causes the pin 118 to return to its original position. In such embodiments, the pin 118 pushes up through the corresponding through-hole 117 to a position above the surface of the second arm 104.

Figure 4:
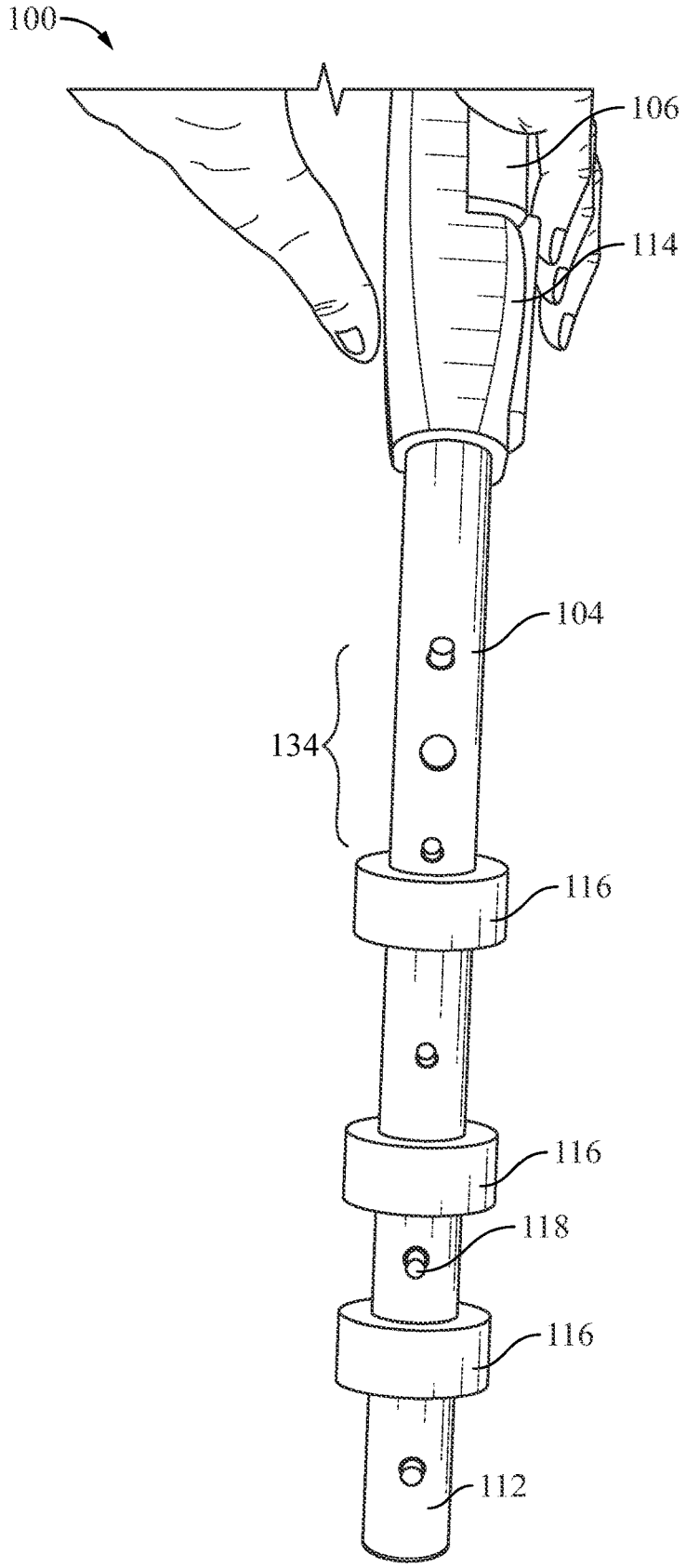
FIG. 4 illustrates a side view of the rehabilitation and strengthening apparatus of FIG. 3.

In some embodiments, the apparatus 100 comprises two or more pins (118*a*, 118*b*, 118*c*, . . . 118*n*) located along a longitudinal axis of the second arm 104. In such embodiments, two consecutive pins 118 (e.g., 118*a*, 118*b*) define a section 134 (e.g., 134*a*) of the one or more discrete sections (134*a*, 134*b*, 134*c*, 134*d*, . . . 134*n*). In some embodiments, each of the two consecutive pins 118 (e.g., 118*a*, 118*b*) of the one or more pins (118*a*, 118*b*, 118*c*, . . . 118*n*) is configured with a suitable size and shape for retaining a weight 116 (e.g., 116*a*) of the one or more weights (116*a*, 116*b*, 116*c*, . . . 116*n*) within the section (e.g., 134*a*) defined by the two consecutive pins. For example, as shown in FIG. 4, the two consecutive pins 118*a* and 118*b* are configured to retain the weight 116*a* within the section 134*a*.

In some embodiments, the second arm 104 comprises at least one discrete section 134, or at least two discrete sections (134*a*, 134*b*), or at least three discrete sections (134*a*, 134*b*, 134*c*), or at least four discrete sections (134*a*, 134*b*, 134*c*, 134*d*), or at least five discrete sections (134*a*, 134*b*, 134*c*, 134*d*, 134*e*), etc. The number of sections 134 generally depends on the overall length of the second arm 104 as well as the range of motion required for a particular exercise.

Figure 7:
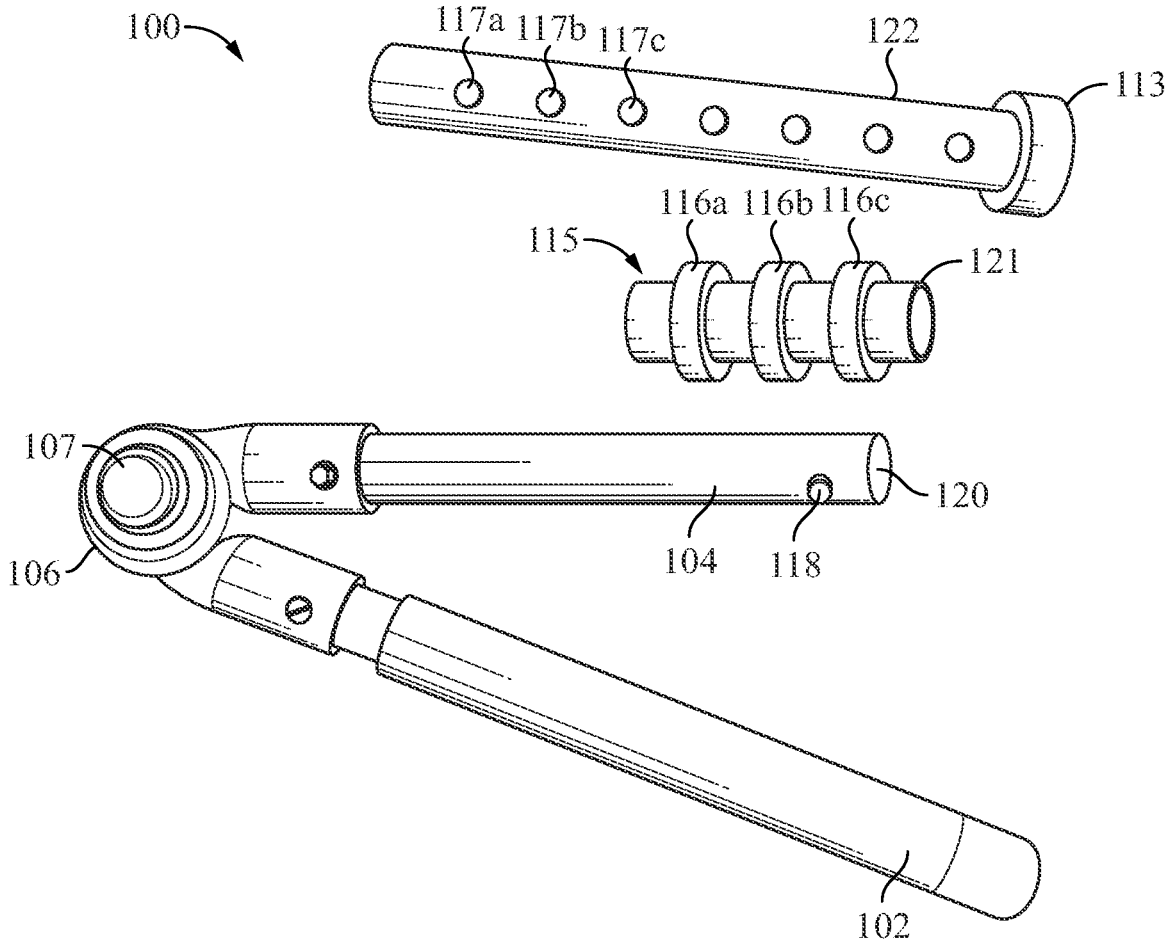
FIG. 7 illustrates a front view of a rehabilitation and strengthening apparatus with the second arm having two or more arm components (120, 115, 122), according to some embodiments described herein.

As shown in FIG. 7, in some embodiments, the apparatus 100 comprises a single pin 118. The pin 118 can be located along the longitudinal axis and positioned relative to the longitudinal axis of the first arm 102 in any suitable place. In some embodiments, a component other than a second pin is utilized to create auditory feedback. In FIG. 7, for example, the pin 118 is located proximate to the distal end of the second component 120. In such embodiments, the first component 122 comprises a plurality of through-holes 117 (e.g., 117*a*, 117*b*, 117*c* . . . 117*n*), and the length of the second arm 104 is determined by which through-hole 117 the pin 118 is inserted through.

In some embodiments, the pin 118 on the second arm 104 is located closer to the proximal end 114 than to the distal end 112, and an endcap 113 located at the distal end 112 functions as a stop for the weight. In some embodiments, the endcap is 113 formed of a material (e.g., a metal or metal alloy) that is capable of providing auditory feedback when contacted by a weight 116. For example, as a weight 116 slides along the second arm 104 it would be stopped in one direction by the pin 118, which causes a noise when contacted by the weight 116, and then stopped in the opposite direction by the endcap 113, which causes a noise when contacted by the weight 116. As shown in FIG. 7, in some embodiments, the second arm 104 comprises a first and second components 120, 122, and the endcap 113 is located at the distal end of the first component 122.

In some embodiments, the endcap 113 is slidably inserted into an opening on the distal end of the second arm 104. In some embodiments, the inner surface of the distal end of the second arm 105 is threaded, and the endcap 113 comprises a complementary threaded component that can be threadably coupled to the second arm 104. Other suitable coupling means are contemplated.

In some embodiments, a collar clamp or equivalent component can be utilized as a stop that is capable of stopping the weight 116 as it slides toward the proximal end 114 of the second arm 104. In such embodiments, the collar is formed of a material (e.g., a metal or metal alloy) that is capable of providing auditory feedback when contacted by the weight 116.

In some embodiments, as shown in FIG. 7, the apparatus 100 comprises a weighted sleeve 115. In such embodiments, the weighted sleeve 115 is configured to removably slide over the second arm 104. The weighted sleeve 115 is configured to carry out the dual functions of the weight 116; that is, provide an increase in the intensity and/or difficulty of the exercises utilizing the apparatus 100, and producing an auditory feedback signal to the user signifying the completion of a full range of motion repetition for a rehabilitative exercise.

In some embodiments, the weighted sleeve 115 is manufactured as a single, unitary component having a particular weight. In some embodiments, the weighted sleeve 115 comprises a plurality of components. For example, in FIG. 7, the weighted sleeve 115 comprises an elongate component 121 (e.g., a tubular component) that is configured to slide through one or more weights 116 having a through-hole configured to receive the elongate component. In some embodiments, the one or more weights 116 can be permanently coupled to the elongate component 121. In such embodiments, where the weights 116 are securably coupled to the elongate component 121, the auditory signal would be produced when the elongated structure 121 slides into and makes contact with a pin 118 or endcap 113. Alternatively, in some embodiments, the weights 116 are not permanently fixed to the elongate component 121. For example, in some embodiments, the elongate component 121 comprises a tubular structure and the one or more weights 116 comprises a circular through-hole configured to receive the tubular component 121. In such embodiments, where the one or more weights 116 are not securably coupled to the weighted sleeve 115, the one or more weights can slide along the longitudinal axis of the tubular component 121 and/or the surface of the first component 122 to produce an auditory response when they contact the pin 118 or endcap 113.

In some embodiments, the weighted sleeve 115 is slidable over the first component 122 in the apparatus 100 shown in FIG. 1 (or, alternatively, the first component 122 slides through an opening of the weighted sleeve 115). In the example of FIG. 1, the weights 116*a*-116*c* would be omitted. In the example, the weighted sleeve 115 would be sized to fit and slide between one or more discrete sections 134. In some embodiments, for example, the second arm 104 comprises two pins (e.g., 118*a* and 118*c*) and the weighted sleeve 115 is sized such that it can fit around the perimeter or circumference of the first arm 104 and also slide along the longitudinal axis of the second arm 104 to make contact with a first pin (e.g., 118*a*), which produces an auditory signal, and then the weighted sleeve 115 can slide in the opposite direction to contact a second pin (e.g., 118*c*), which produces an auditory signal.

In FIG. 7, the second arm 104 comprises a first component 122 having an endcap 113, and a second component 120 comprising a single pin 118. In some embodiments, the first component 122 is configured to slidably receive the weighted sleeve 115. One skilled in the art would appreciate that the one or more weights 116, as shown in FIG. 1 for example, can be utilized on the apparatus 100 shown in FIG. 7 instead of the weighted sleeve 115.

In some embodiments, the hinge 106 is in contact with the proximal ends (110, 114) of the first and second arms (102, 104), respectively. In some embodiments, the hinge 106 is configured to adjust the distance between the distal ends (108, 112) of the first and second arms (102, 104), respectively. In some embodiments, the hinge comprises a first setting in which the distance between the distal ends of the first and second arms is adjustable, and a second setting in which the distance between the distal ends of the first and second arms is locked. For example, the hinge can include a spring-loaded button 107 that, when articulated, allows the first and/or second arms (102, 104) to pivot about the hinge 106 toward or away from each other, and when the button 107 is not articulated, then the first and/or second arms (102, 104) are prevented from pivoting or otherwise being adjusted.

In some embodiments, the hinge 106 is a component from which the first and second arms (102, 104) project out from. In such embodiments, the hinge 106 is configured to adjust the angle between the longitudinal axes of the first and second arms (102, 104). The angle can range, for example, between 0-180° (degrees). When the angle is zero degrees (0°), the first and second arms (102, 104) project in a parallel, or substantially parallel, in the same plane and direction. When the angle is 180° (degrees), the first and second arms (102, 104) form a linear structure, or a substantially linear structure, that includes the hinge 106 along its linear or substantially linear axis. When the angle is between 1-179° (degrees), then the first and second arms (102, 104) project from the hinge 106 in different directions in the same plane, and the angle is measured based on the longitudinal axis defined by each of the arms.

In some embodiments, the hinge 106 comprises a first setting in which the angle between the longitudinal axes of the first and second arms is adjustable, and a second setting in which the angle between the longitudinal axes of the first and second arms is fixed (locked). For example, the hinge can include a spring-loaded button 107 that, when articulated, allows the first and/or second arms (102, 104) to pivot toward or away from each other about the hinge 106. When the button 107 is not articulated, then the first and/or second arms (102, 104) are prevented from pivoting or otherwise being adjusted.

In some embodiments, the hinge 106 allows the first and second arms (102, 104) to be held in parallel positions within the same plane passing through the longitudinal axis of the arms. The hinge 106 permits a user grasping the first handle 102 to swing the arms in and out within the main plane or at right angles thereto, or to rotate the entire bar and to thereby execute more or less complex movements which function to bring into play and develop many of the muscles in the muscular system associated with the user's arms which are uninvolved in conventional arm exercisers.

In some embodiments, the apparatus 100 comprises an object that is configured to roll within the longitudinal, tubular second arm 104, and which is capable of providing an auditory response when the object contacts the endcap 113 at the distal end of the second arm 104, or a component of the hinge 106 at the proximal end of the second arm 104. For example, in some embodiments, the apparatus 100 comprises a ball bearing, marble, or other spherically shaped object that is capable of rolling from the distal end to the proximal end of the second arm 104. In such embodiments, the object produces an auditory response when the user completes a half or full range of motion. For example, in the exercise shown in FIGS. 8A and 8B, the object will roll down the second arm toward the end cap and produce an auditory signal confirming the object had contacted the end cap 113 after the second arm 104 passes below a horizontal plane (in which the first and second arms are on both perpendicular to the sky/ground). This is a half-repetition. In FIG. 8B, the user rotates their wrist up and rotates their first toward their face, and when the angle of the second arm 104 rises above a level, horizontal plane, the object will roll back toward the hinge 106. When the enclosed object contacts a component of the hinge 106, a second auditory response will signal a full range of motion exercise repetition.

In some embodiments, the apparatus 100 produces an auditory feedback using an electronic mechanism. In some embodiments, an electronic device (not shown) comprising a power supply (e.g. a battery, including a rechargeable battery), a computing unit, and one or more sensors, wherein the device is integrated into the second arm 104. In such embodiments, the electronic device is configured to sense when the second arm 104 has been moved past a predetermined threshold, such as a horizontal plane defined by the first and second arms 102, 104. Any suitable sensor can be used in the device, including, for example, a motion sensor, a gesture detector, etc. In some embodiments, the device further comprises a communication component for transmitting a signal from the sensor to an external device, such as a mobile device. The transmission of the signal can be carried out using any suitable means, including, for example, wireless technology (e.g., Bluetooth). In some embodiments, the device communicates with an application on a mobile phone, the application comprising software configured to allow the application to receive the transmitted signal, converting the signal as need, and producing an auditory signal to the user (e.g., a sound indicating the completion of an exercise repetition). In some embodiments, the application software is configured to store and provide any data associated with the sensors in the device and/or exercise repetitions.

In various embodiments, a rehabilitation and strengthening kit for a person having epicondylitis is provided. In some embodiments, the kit comprises an apparatus 100, a plurality of weights 116, and instructions for flexion, extension, supination, pronation, radial deviation, and ulnar deviation exercises that treat epicondylitis. In some embodiments, the apparatus 100 comprises a first arm 102 comprising a proximal end 110 and a distal end 108, a second arm 104 comprising a proximal end 114, a distal end 112, and one or more discrete sections 134 therebetween for engaging one or more weights 116; and a hinge 106 in contact with the proximal ends of the first and second arms, and the hinge 106 is configured to adjust the distance between the distal ends of the first and second arms. In some embodiments, the apparatus 100 comprises a first arm 102 comprising a handle along a longitudinal axis, a second arm 104 comprising one or more discrete sections 134 along a longitudinal axis for receiving one or more weights 116 in each section, and a hinge 106 from which the first and second arms project; and the hinge 106 is configured to adjust the angle between the longitudinal axes of the first and second arms. In some embodiments, each weight 116 comprises a through-hole configured to slidably receive the second arm 104.

In various embodiments, a method of treating a person having epicondylitis is provided. In some embodiments, the method comprises: providing the rehabilitation and strengthening kit, optionally sliding one or more weights 116 from the plurality of weights onto the second arm 104, and articulating the apparatus 100 according to the instructions for each of the flexion, extension, supination, pronation, radial deviation, and ulnar deviation exercises to rehabilitate and strengthen muscles to treat epicondylitis.

The flexion, extension, supination, pronation, radial deviation, and ulnar deviation exercises are shown in FIGS. 8A-13B. In some embodiments, each of the six exercises requires a specific movement and each movement focuses on different muscles in the user's forearm.

In various embodiments, a user will utilize concentric movement exercises, which are "two-way" movements in which the weight starts in a low position, is moved to a higher position, and finishes in the low position, to build strength in healthy forearm muscles. In some embodiments, the apparatus 100 enables a full regimen of the six most prescribed forearm exercises—flexion, extension, supination, pronation, radial deviation, and ulnar deviation—to be performed in concentric movement.

When the apparatus 100 is in use, each of the concentric exercises begins with the second arm 104 pointing in a downward direction, and each exercise ends with the second arm 104 rotated positioned slightly above horizontal. First, the user grips the apparatus 100 on the first arm 102, as shown in FIGS. 8A, 9A, 10A, 11A, 12A, and 13A. The user then raises the second arm 104 with a slow, controlled movement. As the second arm 104 approaches the end position, a point just past the horizontal plane, gravity will cause the weight 116 to slide along the surface of the second arm 104 and make an audible click when it contacts an adjacent pin 118. The click indicates that the user has reached the end of the range of motion. If the user does not hear an audible click, then the grip on the first arm 102 should be adjusted as necessary to ensure an auditory feedback. For example, the adjustment can include the following steps: user loosens grip on the handle of the first arm 102; user rotates the apparatus 100 slightly upward; and user then tightens the grip and attempts exercise again. A click should occur when the hand attached to the first arm 102 has reached the end of its range of motion and can travel no further in the desired direction. Returning to the exercise, the second arm 104 should then be returned to the starting position to complete one exercise repetition. When the weight 116 slides back to its original position, the user should hear another click as the weight 116 contacts the pin 118 on the opposing end of the section 134. The user should then repeat the exercise a prescribed number of times.

Figure 8A:
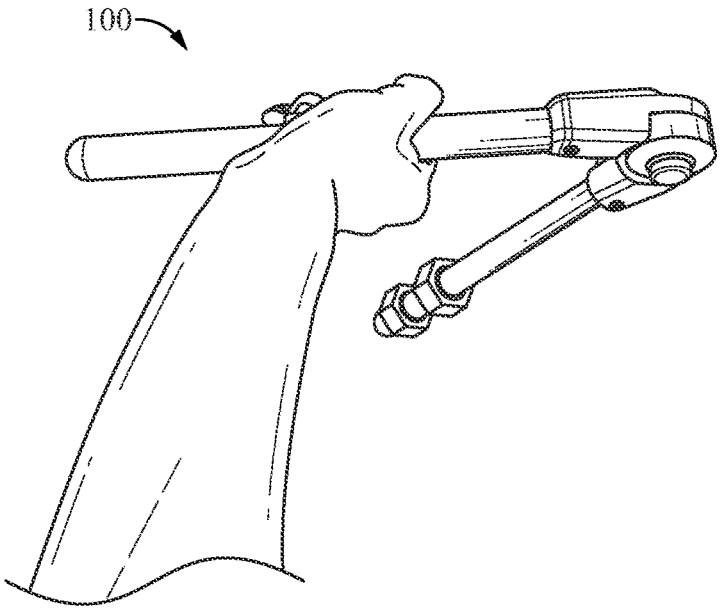
FIG. 8A and FIG. 8B illustrate the use of the apparatus of FIG. 3 in a flexion exercise.
Figure 8B:
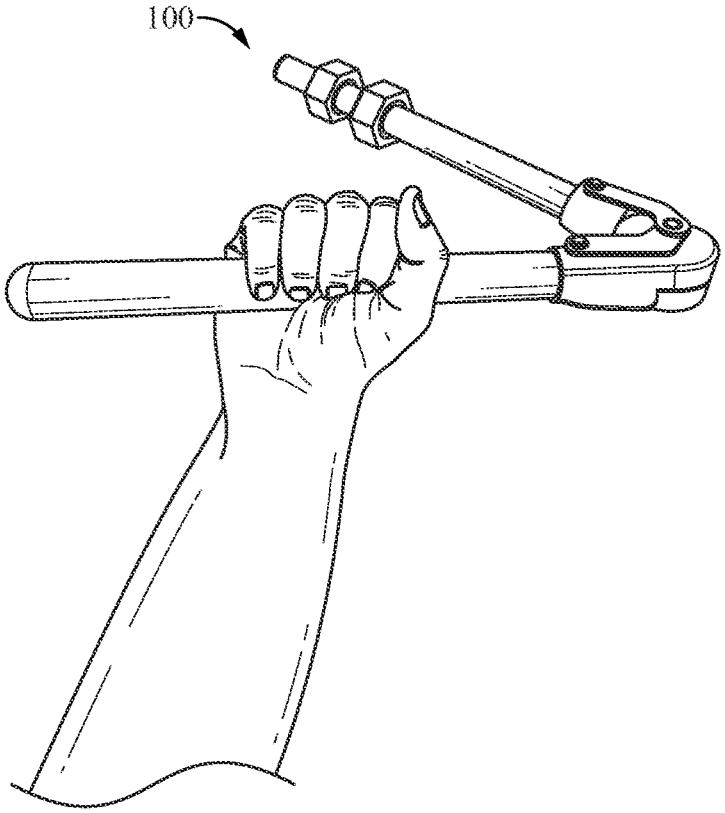

FIGS. 8A and 8B show the use of the apparatus 100 in a flexion exercise. To begin, the apparatus 100 is adjusted so the first and second arms (102, 104) are at an angle of about 25 degrees to about 55 degrees (e.g., 45 degrees), and the desired number of weights 116 are added to the second arm 104. Next, as shown in FIG. 8A, the user grips the handle on the first arm 102 with the palm of their hand facing outward and so the second arm 104 is below horizontal and pointing downward. The exercise then requires the user to slowly rotate the second arm 104 upward, above horizontal, by bending the wrist and bringing the palm upward so it faces toward the user, as shown in FIG. 8B. When the weight 116 contacts a pin 118, the user should hear a click, which indicates that the end of the range of motion. The user then slowly returns the apparatus 100 to the starting position to complete the repetition. The user should then repeat the exercise a prescribed number of times.

Figure 9A:
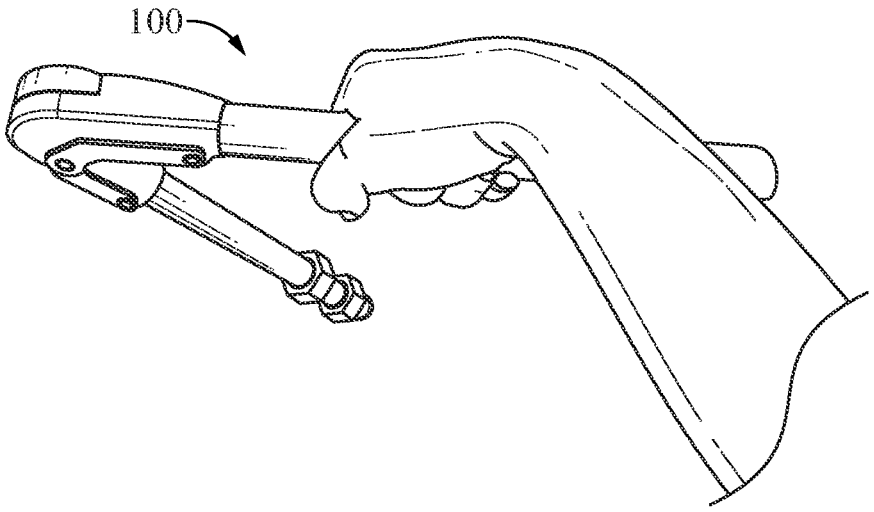
FIG. 9A and FIG. 9B illustrate the use of the apparatus of FIG. 3 in an extension exercise.
Figure 9B:
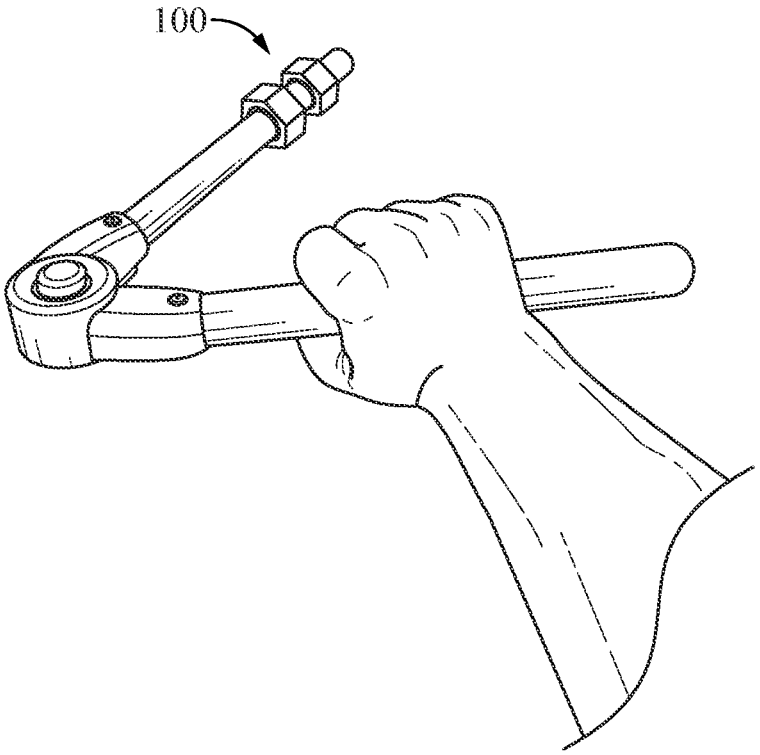

FIGS. 9A and 9B show the use of the apparatus 100 in an extension exercise. To begin, the apparatus 100 is adjusted so the first and second arms (102, 104) are at an angle of about 25 degrees to about 55 degrees (e.g., 45 degrees), and the desired number of weights 116 are added to the second arm 104. Next, as shown in FIG. 9A, the user grips the handle on the first arm 102 with the palm of their hand faces down and slightly toward the user and so the second arm 104 is pointing downward. The exercise then requires the user to slowly rotate the second arm 104 upward by bending the wrist and bringing the palm upward so it faces away from the user, as shown in FIG. 9B. When the weight 116 contacts a pin 118, the user should hear a click, which indicates that the end of the range of motion. The user then slowly returns the apparatus 100 to the starting position to complete the repetition. The user should then repeat the exercise a prescribed number of times.

Figure 10A:
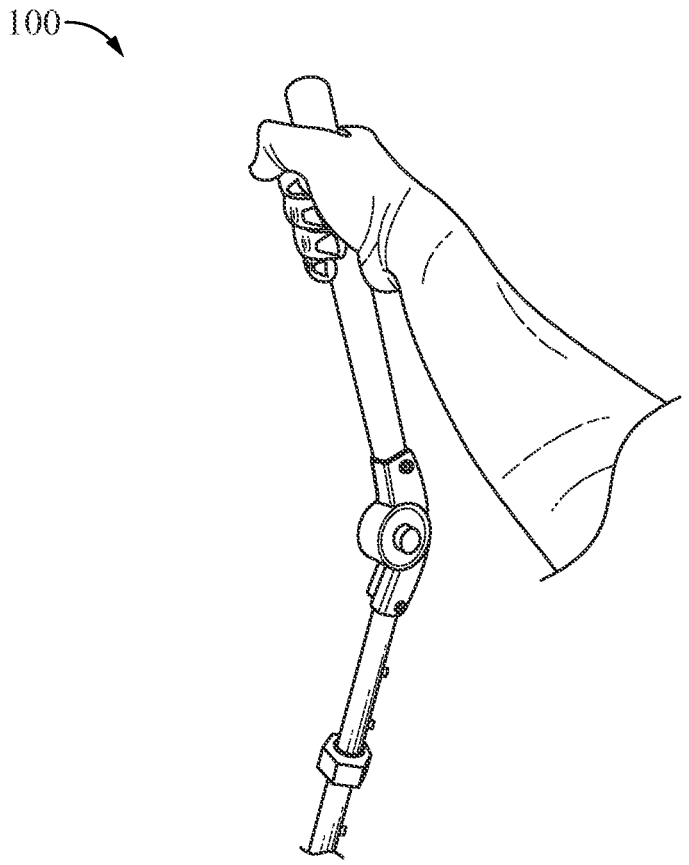
FIG. 10A and FIG. 10B illustrate the use of the apparatus of FIG. 3 in a supination exercise.
Figure 10B:
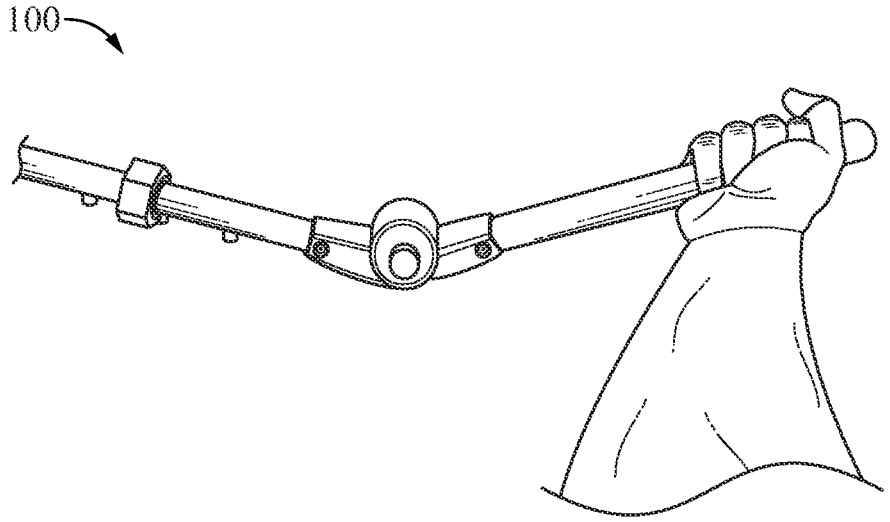

FIGS. 10A and 10B show the use of the apparatus 100 in a supination exercise. To begin, the apparatus 100 is adjusted so the first and second arms (102, 104) are at an angle of about 95 degrees to about 180 degrees (e.g., 130 degrees), and the desired number of weights 116 are added to the second arm 104. Next, as shown in FIG. 10A, the user grips the handle on the first arm 102 with the palm of their hand facing to the side and so the second arm 104 is pointing downwards. The exercise then requires the user to raise the second arm 104 by rotating the palm of their hand upward, as shown in FIG. 10B. When the weight 116 contacts a pin 118, the user should hear a click, which indicates that the end of the range of motion. The user then slowly returns the apparatus 100 to the starting position to complete the repetition. The user should then repeat the exercise a prescribed number of times.

Figure 11A:
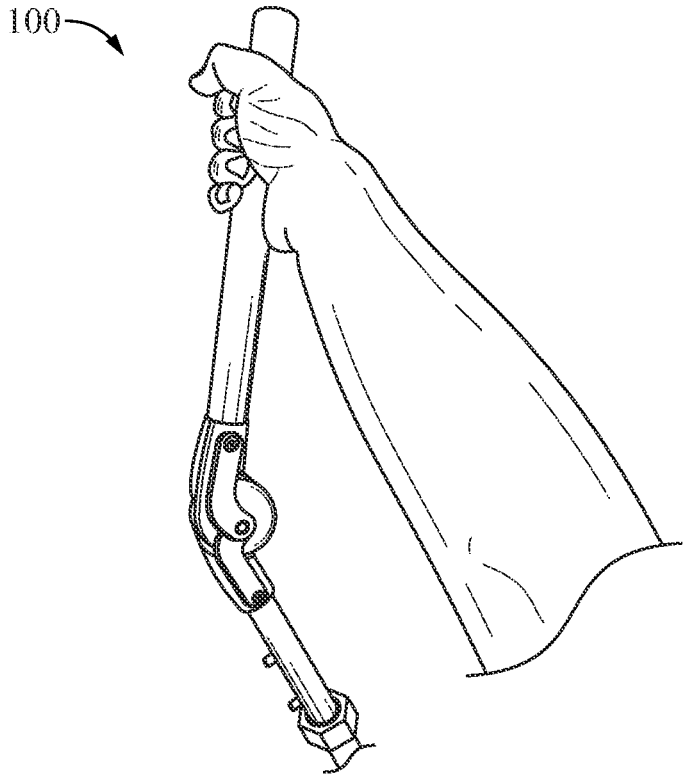
FIG. 11A and FIG. 11B illustrate the use of the apparatus of FIG. 3 in a pronation exercise.
Figure 11B:
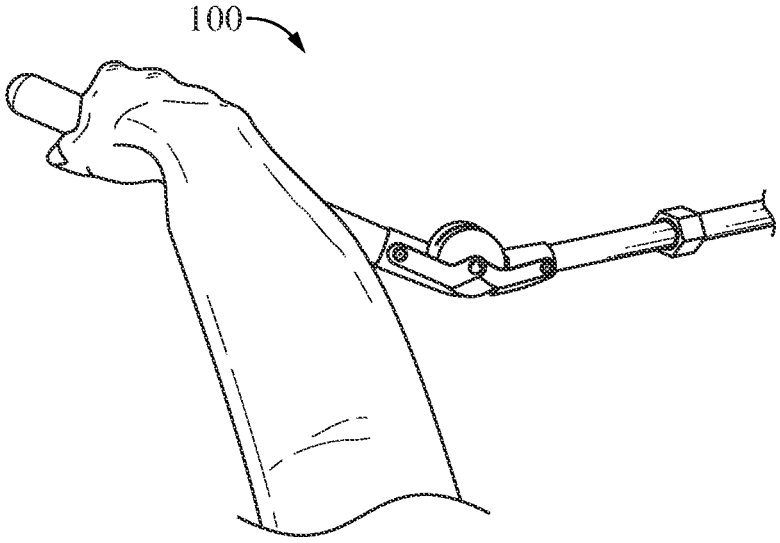

FIGS. 11A and 11B show the use of the apparatus 100 in a pronation exercise. To begin, the apparatus 100 is adjusted so the first and second arms (102, 104) are at an angle of about 95 degrees to about 180 degrees, and the desired number of weights 116 are added to the second arm 104. Next, as shown in FIG. 11A, the user grips the handle on the first arm 102 with the palm of their hand facing to the side and so the second arm 104 is pointing downward. The exercise then requires the user to rotate their wrist, so the palm of their hand faces downward and so the second arm 104 rotates upward to an approximately horizontal position, as shown in FIG. 11B. When the weight 116 contacts a pin 118, the user should hear a click, which indicates that the end of the range of motion. The user then slowly returns the apparatus 100 to the starting position to complete the repetition. The user should then repeat the exercise a prescribed number of times.

Figure 12A:
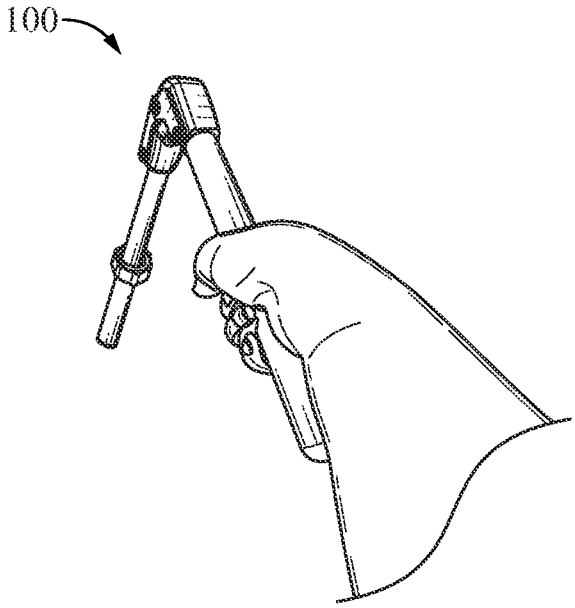
FIG. 12A and FIG. 12B illustrate the use of the apparatus of FIG. 3 in a radial deviation exercise.
Figure 12B:
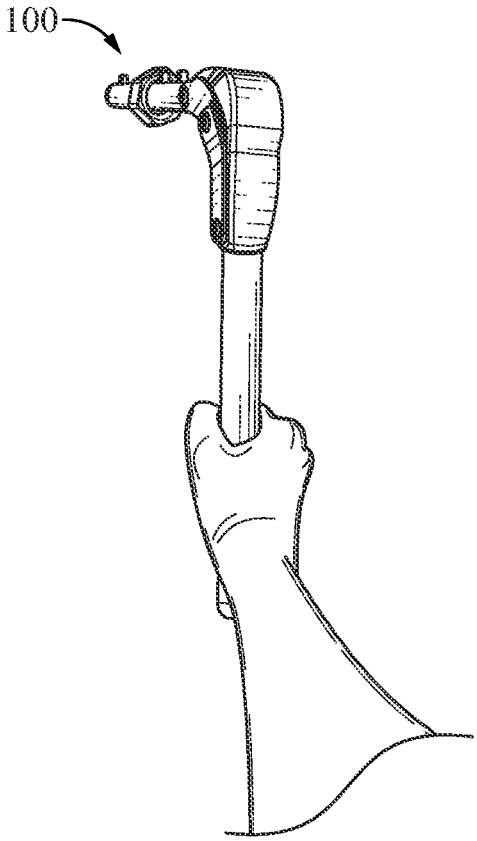

FIGS. 12A and 12B show the use of the apparatus 100 in a radial deviation exercise. To begin, the apparatus 100 is adjusted so the first and second arms (102, 104) are at an angle of about 90 degrees, and the desired number of weights 116 are added to the second arm 104. Next, as shown in FIG. 12A, the user grips the handle on the first arm 102 with the palm of their hand facing to the side and the hand pivoted into a "handshake" grip so the second arm 104 is pointing downward, and the hinge 106 is proximal to the radius bone (on the thumb side of the palm). The exercise then requires the user to slowly raise the second arm 104 by bending the wrist upward while the distal end 112 of the second arm 104 rotates away from the user's elbow toward an approximately horizontal position, as shown in FIG. 12B. When the weight 116 contacts a pin 118, the user should hear a click, which indicates that the end of the range of motion. The user then slowly returns the apparatus 100 to the starting position to complete the repetition. The user should then repeat the exercise a prescribed number of times.

Figure 13A:
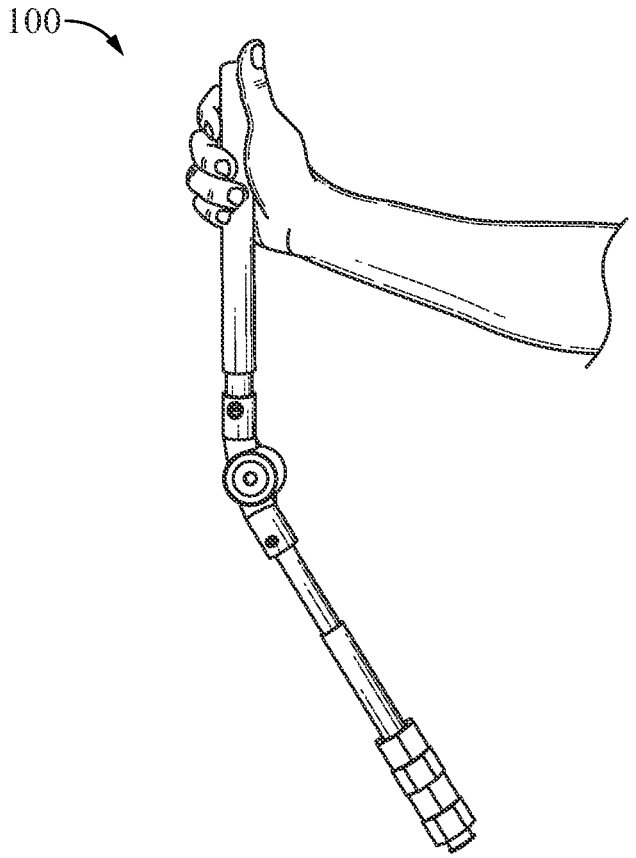
FIG. 13A and FIG. 13B illustrate the use of the apparatus of FIG. 3 in an ulnar deviation exercise.
Figure 13B:
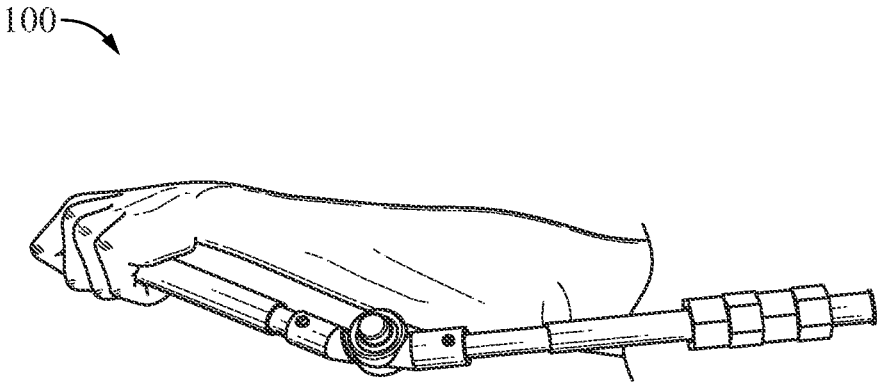

FIGS. 13A and 13B show the use of the apparatus 100 in an ulnar deviation exercise. To begin, the apparatus 100 is adjusted so the first and second arms (102, 104) are at an angle between about 160-180 degrees, and the desired number of weights 116 are added to the second arm 104. Next, as shown in FIG. 13A, the user grips the handle on the first arm 102 with a handshake grip having the hinge 106 proximal to the ulna (little finger side of the palm), so the second arm 104 is pointing in a downward direction. The exercise then requires the user to slowly extend the first arm 102 forward toward a horizontal direction by pivoting the wrist in a downward manner while the distal end 112 of the second arm 104 rotates toward the user's elbow, as shown in FIG. 13B. When the weight 116 contacts a pin 118, the user should hear a click, which indicates that the end of the range of motion. The user then slowly returns the apparatus 100 to the starting position to complete the repetition. The user should then repeat the exercise a prescribed number of times.

In various embodiments, a user will utilize eccentric movement exercises, which are "one-way" movements in which the weight starts in a high position and finishes in a lower position, to rehabilitate forearm muscles. In some embodiments, the apparatus 100 enables a full regimen of the six most prescribed forearm exercises—reverse flexion, reverse extension, reverse supination, reverse pronation, reverse radial deviation, and reverse ulnar deviation—to be performed in eccentric movement.

When the apparatus 100 is in use, each of the eccentric exercises begins with the second arm 104 pointing in an upward direction, and each exercise ends with the second arm 104 rotated positioned slightly below horizontal. First, the user grips the apparatus 100 on the first arm 102, and then lowers the second arm 104 with a slow, controlled movement. As the second arm 104 approaches the end position, a point just past the horizontal plane, gravity will cause the weight 116 to slide along the surface of the second arm 104 and make an audible click when it contacts an adjacent pin 118. The click indicates that the user has reached the end of the range of motion. If the user does not hear an audible click, then the grip on the first arm 102 should be adjusted as necessary to ensure an auditory feedback. For example, the adjustment can include the following steps: user loosens grip on the handle of the first arm 102; user rotates the apparatus 100 slightly downward; and user then tightens the grip and attempts exercise again. A click should occur when the hand attached to the first arm 102 has reached the end of its range of motion and can travel no further in the desired direction. In these exercises, the second arm 104 is returned to the starting position with the assistance of the free until the user hears a click, indicating the completion of one exercise repetition. The user should then repeat the exercise a prescribed number of times.

In various embodiments, a reverse flexion, reverse extension, reverse supination, reverse pronation, reverse radial deviation, and reverse ulnar deviation exercises can be envisioned using the steps described for FIGS. 8A-13B in reverse.

FIGS. 8A and 8B show the use of the apparatus 100 in a reverse flexion exercise. To begin, the apparatus 100 is adjusted so the first and second arms (102, 104) are at an angle of about 25 degrees to about 55 degrees, and the desired number of weights 116 are added to the second arm 104. Next, as shown in FIG. 8B. the user grips the handle on the first arm 102 with the palm of their hand facing upward and toward the user and so the second arm 104 is above horizontal and pointing upward. The exercise then requires the user to slowly rotate the second arm 104 downward by bending the wrist and taking the palm of the hand downward so it faces away from the user, as shown in FIG. 8A. When the weight 116 contacts a pin 118, the user should hear a click, which indicates that the end of the range of motion. The user can then use their free hand to return the apparatus 100 to the starting position to complete the repetition. The user should then repeat the exercise a prescribed number of times.

FIGS. 9A and 9B show the use of the apparatus 100 in a reverse extension exercise. To begin, the apparatus 100 is adjusted so the first and second arms (102, 104) are at an angle of about 25 degrees to about 55 degrees (e.g., 45 degrees), and the desired number of weights 116 are added to the second arm 104. Next, as shown in FIG. 9B, the user grips the handle on the first arm 102 with the palm of their hand facing outward and away from the user and so the second arm 104 is above horizontal and pointing upward. The exercise then requires the user to slowly rotate the second arm 104 downward, below horizontal, by bending the wrist so the palm of the hand faces down, as shown in FIG. 9A. When the weight 116 contacts a pin 118, the user should hear a click, which indicates that the end of the range of motion. The user can then use their free hand to return the apparatus 100 to the starting position to complete the repetition. The user should then repeat the exercise a prescribed number of times.

FIGS. 10A and 10B show the use of the apparatus 100 in a reverse supination exercise. To begin, the apparatus 100 is adjusted so the first and second arms (102, 104) are at an angle of about 95 degrees to about 180 degrees (e.g., 130 degrees), and the desired number of weights 116 are added to the second arm 104. Next, as shown in FIG. 10B, the user grips the handle on the first arm 102 with the palm of their hand facing upward and so the second arm 104 is almost horizontal. The exercise then requires the user to lower the second arm 104 by rotating their wrist so the palm of their hand faces to the side, as shown in FIG. 10A. When the weight 116 contacts a pin 118, the user should hear a click, which indicates that the end of the range of motion. The user can then use their free hand to return the apparatus 100 to the starting position to complete the repetition. The user should then repeat the exercise a prescribed number of times.

FIGS. 11A and 11B show the use of the apparatus 100 in a reverse pronation exercise. To begin, the apparatus 100 is adjusted so the first and second arms (102, 104) are at an angle of about 95 degrees to about 180 degrees, and the desired number of weights 116 are added to the second arm 104. Next, as shown in FIG. 11B, the user grips the handle on the first arm 102 with the palm of their hand facing downward and so the second arm 104 rotates upward to an approximately horizontal position. The exercise then requires the user to rotate their wrist, so the palm of their hand faces to the side and so the second arm 104 is pointing downward, as shown in FIG. 11A. When the weight 116 contacts a pin 118, the user should hear a click, which indicates that the end of the range of motion. The user can then use their free hand to return the apparatus 100 to the starting position to complete the repetition. The user should then repeat the exercise a prescribed number of times.

FIGS. 12A and 12B show the use of the apparatus 100 in a reverse radial deviation exercise. To begin, the apparatus 100 is adjusted so the first and second arms (102, 104) are at an angle of about 90 degrees, and the desired number of weights 116 are added to the second arm 104. Next, as shown in FIG. 12B, the user grips the handle on the first arm 102 with the palm of their hand facing to the side and the hand pivoted upward so the second arm 104 is approximately horizontal. The exercise then requires the user to slowly lower the second arm 104 by bending the wrist downward, so the hand is in a "handshake" grip and the second arm 104 is pointing downward, as shown in FIG. 12B. When the weight 116 contacts a pin 118, the user should hear a click, which indicates that the end of the range of motion. The user can then use their free hand to return the apparatus 100 to the starting position to complete the repetition. The user should then repeat the exercise a prescribed number of times.

FIGS. 13A and 13B show the use of the apparatus 100 in a reverse ulnar deviation exercise. To begin, the apparatus 100 is adjusted so the first and second arms (102, 104) are at an angle between about 160-180 degrees, and the desired number of weights 116 are added to the second arm 104. Next, as shown in FIG. 13B, the user grips the handle on the first arm 102 with a handshake grip such that the hinge 106 is oriented proximal to the ulna (little finger side of the palm), so the second arm 104 is pointing generally horizontal toward the user's elbow. The exercise then requires the user to slowly lower the second arm 104 by pivoting their wrist upward while the distal end 112 of the second arm 104 moves downward toward the ground, as shown in FIG. 13A. When the weight 116 contacts a pin 118, or an endcap, the user should hear a click indicating the end of the range of motion. The user can then use their free hand to return the apparatus 100 to the starting position to complete the repetition. The user should then repeat the exercise a prescribed number of times.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

That is claimed is:

1. An apparatus for rehabilitation and strengthening, the apparatus comprising:

a first arm comprising a proximal end and a distal end;

a second arm comprising a proximal end, a distal end, and one or more discrete sections therebetween for engaging one or more weights; and a hinge in contact with the proximal ends of the first and second arms, wherein the hinge is configured to adjust a distance between the distal ends of the first and second arms such that the first and second arms are capable of projecting from the hinge substantially parallel to one another in a same plane and direction.

2. The apparatus of claim 1, wherein the one or more discrete sections are each defined by a spaced distance between two stops.

3. The apparatus of claim 2, wherein the two stops respectively comprise two pins located along a longitudinal axis of the second arm, wherein the spaced distance between the two pins defines a section of the one or more discrete sections and the two pins are configured to retain a weight of the one or more weights in the section defined therebetween.

4. The apparatus of claim 3, wherein the weight of the one or more weights is slidable between the two pins, and when the weight of the one or more weights contacts one or both of the two pins, an auditory feedback is configured to be provided.

5. The apparatus of claim 2, wherein the two stops comprise a pin located along a longitudinal axis of the second arm and an endcap located at the distal end of the second arm;

wherein the spaced distance between the pin and the endcap defines a section of the one or more discrete sections and each of the pin and the endcap is configured to retain a weight of the one or more weights in the section defined therebetween.

6. The apparatus of claim 5, wherein the weight of the one or more weights is slidable between the pin and the endcap, and when the weight of the one or more weights contacts one or both of the pin and the endcap, an auditory feedback is configured to be provided.

7. The apparatus of claim 2, wherein the one or more weights can slide between the two stops, and when the one or more weights contact one or both of the two stops, an auditory feedback is configured to be provided to a user.

8. The apparatus of claim 1, wherein the second arm comprises an adjustable length.

9. The apparatus of claim 1, wherein the second arm comprises two or more components, whereby a first component of the two or more components is configured to slidably receive a second component of the two or more components to adjust a length of the second arm.

10. The apparatus of claim 1, wherein the second arm is slidable through an opening in the one or more weights.

11. The apparatus of claim 1, wherein the hinge comprises a first setting in which the distance between the distal ends of the first and second arms is adjustable, and a second setting in which the distance between the distal ends of the first and second arms is locked.

12. The apparatus of claim 1, wherein the first arm comprises a handle along a longitudinal axis of the first arm, the second arm comprises a longitudinal axis wherein each of the one or more discrete sections is defined by a spaced distance between two stops, and the hinge is configured to adjust an angle between the longitudinal axes of the first and second arms; and wherein the second arm comprises an adjustable length along the longitudinal axis of the second arm.

13. The apparatus of claim 12, wherein the two stops respectively comprise two pins located along the longitudinal axis of the second arm;

wherein the two pins are configured to retain a weight of the one or more weights in a section defined therebetween.

14. The apparatus of claim 12, wherein the two stops comprise a pin located along the longitudinal axis of the second arm and an endcap located at the distal end of the second arm;

wherein the spaced distance between the pin and the endcap defines a section of the one or more discrete sections and each of the pin and the endcap is configured to retain a weight of the one or more weights in the section defined therebetween.

15. The apparatus of claim 12, wherein a weight of the one or more weights can slide between a consecutive two stops, and when the weight of the one or more weights contacts one of the consecutive two stops an auditory feedback is configured to be provided.

16. The apparatus of claim 12, wherein the hinge comprises a first setting in which the angle between the longitudinal axes of the first and second arms is adjustable, and a second setting in which the angle between the longitudinal axes of the first and second arms is locked.

17. A rehabilitation and strengthening kit, comprising:

an apparatus, comprising:

a first arm comprising a proximal end and a distal end;

a second arm comprising a proximal end, a distal end, and one or more discrete sections therebetween for engaging one or more weights; and a hinge in contact with the proximal ends of the first and second arms, wherein the hinge is configured to adjust a distance between the distal ends of the first and second arms such that the first and second arms are capable of projecting from the hinge substantially parallel to one another in a same plane and direction;

the one or more weights comprising a through-hole configured to slidably receive the second arm; and instructions for flexion, extension, supination, pronation, radial deviation, and ulnar deviation exercises that treat epicondylitis.

18. The rehabilitation and strengthening kit of claim 17, wherein the apparatus comprises:

a handle along a longitudinal axis of the first arm;

the one or more discrete sections are positioned along a longitudinal axis of the second arm for respectively receiving the one or more weights in each discrete section; and the hinge is configured to adjust an angle between the longitudinal axes of the first and second arms.

19. A method of treating a person having epicondylitis, comprising:

providing the rehabilitation and strengthening kit of claim 18;

optionally sliding the one or more weights onto the second arm; and articulating the apparatus according to the instructions for each of the flexion, extension, supination, pronation, radial deviation, and ulnar deviation exercises to rehabilitate and strengthen muscles to treat epicondylitis.

20. The method of claim 19, further comprising:

sliding the one or more weights onto the second arm.

* * * * *